US009097421B2

(12) United States Patent
Grant

(10) Patent No.: US 9,097,421 B2
(45) Date of Patent: Aug. 4, 2015

(54) ENCLOSED GRANULAR FUEL BURNING BOILER

(76) Inventor: Stephen William John Grant, Birr (IE)

( * ) Notice: Subject to any disclaimer, the term of this patent is extended or adjusted under 35 U.S.C. 154(b) by 94 days.

(21) Appl. No.: 13/165,983

(22) Filed: Jun. 22, 2011

(65) Prior Publication Data

US 2012/0017811 A1 Jan. 26, 2012

(30) Foreign Application Priority Data

Jun. 22, 2010 (GB) ..... 1010460.2

(51) Int. Cl.

| | |
|---|---|
| ***F23J 1/06*** | (2006.01) |
| ***F23H 13/06*** | (2006.01) |
| ***F23H 15/00*** | (2006.01) |
| ***F23B 10/00*** | (2011.01) |
| ***F23B 60/02*** | (2006.01) |
| ***F23B 80/04*** | (2006.01) |

(52) U.S. Cl.

CPC . *F23J 1/06* (2013.01); *F23B 10/00* (2013.01); *F23B 60/02* (2013.01); *F23B 80/04* (2013.01); *F23H 15/00* (2013.01)

(58) Field of Classification Search

CPC ..... F23B 1/08; F23B 10/00; F23B 10/02; F23B 60/02; F23B 80/04; F23H 15/00; F23J 1/06; F23J 1/00; F23J 2700/00; F23J 2700/001; F23J 2700/002; F23J 2700/003

USPC ..... 110/165 R, 167, 259, 317, 318, 331, 110/289, 293, 322, 125, 119, 165 A, 234, 110/267, 297, 346; 126/242, 243, 245, 542, 126/550, 303, 299 F, 7, 10, 11, 68, 73, 74

See application file for complete search history.

(56) References Cited

U.S. PATENT DOCUMENTS

| | | | | |
|---|---|---|---|---|
| 4,366,802 | A | 1/1983 | Goodine | |
| 4,474,117 | A * | 10/1984 | Marollaud | 110/109 |
| 6,588,350 | B1 * | 7/2003 | Somers | 126/68 |
| 7,318,431 | B1 * | 1/2008 | Holtan et al. | 126/73 |
| 2007/0125281 | A1 | 6/2007 | Ingvarsson | |
| 2007/0215021 | A1 | 9/2007 | Krumrei | |

FOREIGN PATENT DOCUMENTS

| | | |
|---|---|---|
| CH | 380919 | 8/1964 |
| DE | 1297799 | 6/1969 |
| DE | 202005011610 U1 * | 11/2005 |
| EP | 2187122 | 5/2010 |
| FR | 1274230 | 11/1960 |
| GB | 1231684 | 5/1971 |
| GB | 2274162 | 7/1994 |

(Continued)

*Primary Examiner* — Kenneth Rinehart
*Assistant Examiner* — Tavia Sullens
(74) *Attorney, Agent, or Firm* — Ann I. Dennen; Lanier Ford Shaver & Payne P.C.

(57) ABSTRACT

There is illustrated a fuel fired brazier for an enclosed granular fuel burning boiler. The brazier has an apertured grate-like brazier base. The brazier base is moved by an actuator from an operative position, retaining fuel in the brazier to a discharge position where ash can fall through a hole. At the same time, fragmentation means, formed by crushing teeth, move across the brazier to trap, for example, a large piece of clinker, between it and the opposed distal wall of the brazier.

14 Claims, 7 Drawing Sheets

(56) References Cited

FOREIGN PATENT DOCUMENTS

| | | |
|---|---|---|
| GB | 2465550 | 5/2010 |
| IE | 2007/0226 | 10/2008 |
| JP | 2001208329 | 8/2001 |
| JP | 2004138256 | 5/2004 |
| KR | 100934347 | 12/2009 |
| WO | 9202762 | 2/1992 |
| WO | 2008/068587 | 6/2008 |
| WO | WO2010/072830 | 7/2010 |

* cited by examiner

ENCLOSED GRANULAR FUEL BURNING BOILER

CROSS-REFERENCE TO RELATED APPLICATION

This application claims priority from UK Patent Application No. 1010460.2 filed on 22 Jun. 2010, the entire contents of which are herein incorporated by reference.

INTRODUCTION

This invention relates to granular fuel burning boilers.

The invention particularly relates to an enclosed granular fuel burning boiler of the type comprising:

- a fuel-fired brazier comprising an apertured grate-like brazier base and upstanding side walls, namely a proximal wall, a distal wall and a pair of connecting side walls, and the base being movable from an operative position retaining fuel in the brazier to a discharge position to allow ash contents to fall out of the brazier;
- fragmentation means so as to break up any vitrified ash contents in the brazier when the brazier base is moved to the discharge position;
- and
- a fan for delivering air to the brazier through a plenum chamber.

The terms "distal" and " proximal" are used in this specification to refer to the portion of a part further into the boiler for the former term, and that portion closer to the boiler wall for the latter.

Also the terms "upper" and "lower" and any equivalent or variations thereof are used to refer to the position within the boiler having regard to a boiler being in situ and resting on a horizontal surface.

BACKGROUND OF THE INVENTION

It should be noted that a considerable amount of the pertinent prior art in respect of this technology is disclosed in various patent applications filed designating the present applicant as inventor. These include PCT WO2010/072830 entitled to "A dual fuel boiler" and European patent specification number EP 2 187 122 entitled "A granular fuel-fired boiler brazier".

One of the major problems with such granular fuel burning boilers is the removal of ash contents from the boiler. Much of the granular fuel is normally pelleted wood. Unfortunately, such pelleted wood contains impurities and what is effectively sand which is ingested through the bark of the tree as it grows. When it burns, the ash content is made up of relatively soft combustion products, almost pure carbon dust and what is a vitrified clinker, very similar to glass. It should be appreciated that the ash usually weighs somewhat of the order of 0.5% of the weight of the fuel and the vitrified clinker is somewhat of the order of 1 to 2% by weight of the ash. Thus, it is a relatively small proportion of the combustion products. However, because of its effect, it is found to be a not insignificant component of the ash contents. What happens is that this vitrified clinker forms a skin over the base of the brazier and prevents air being delivered up into the burning fuel from underneath. The way in which the combustion products are removed from the brazier is to move the base of the brazier away from it's side walls to allow the combustion products to fall out of the brazier. There are considerable problems with this as the vitrified clinker does not fall through the brazier but bridges the brazier retaining the softer ash. A particularly useful means of breaking up this vitrified clinker on discharging the brazier is described in the co-pending British Patent Application Number 0821060.1, filed by my company However, even with this extremely efficient invention, we have found some slight, albeit minor, problems with the operation of this fragmentation means and the present application is directed towards attending to this. With many other solid granular fuels, this problem is exacerbated. It is hard to over emphasise the difficulties that such vitrified ash causes.

A further problem with these boilers for burning granular fuel is that they are usually arranged so that there is a hood over the brazier, which hood is essential to retain the burning products to ensure that they burn correctly before being dissipated out of the boiler. A typical example of such a hood is described in GB Patent Specification Number 22 274 162 A (Jonathon Greenall). Even with such hoods, there is a problem in that the amount of carbon monoxide (CO) in the boiler flue, on discharge, is relatively large, at best being somewhat of the order of 100 ppm and, at worst, 1000 ppm or even more. Clearly, if this could be improved on, it would be advantageous. Ideally, the amount of carbon monoxide should not exceed 100 ppm. A further problem with these hoods is that they disintegrate fairly rapidly in use and require constant replacement. The problem is that to be effective, the hood must trap hot combustion gases to ensure adequate combustion before delivery out of the brazier enclosure. Since the hood will be directly above the brazier and the gases will naturally rise to impinge against the hood, the hood is under severe stress. A typical solution to this problem is to provide a hollow hood such as described in the aforementioned GB Patent Specification Number 22 274 162. However, there are still considerable problems in producing an efficient construction of such a hood which will ensure minimal amounts of carbon monoxide.

Another problem with these boilers for burning granular fuels such as wood pellets is the necessity to make sure that the granular fuel is delivered onto the burning fuel bed as gently as possible so as not to disturb the burning fuel already there. The problem is that if the burning fuel within the brazier is disturbed, then the lighter ash will be prematurely delivered out of the brazier into the boiler itself or more usually into the ash pan, rather than being retained for subsequent delivery to an ash pan on complete combustion taking place. Any incompletely combusted fuel which is light can also be delivered out of the boiler enclosure into the ash pan where it will smoulder producing carbon monoxide. Any ash delivered into the boiler itself will almost certainly form a thin layer on the inside of the boiler reducing the heat transfer properties. Accordingly, the less disturbance of the burning fuel the better. Accordingly, disturbing the burning fuel also reduces the efficiency of the burning operation and generates more carbon monoxide.

Another problem with these boilers is to ensure that there is adequate air available for combustion. It has been found, for example, that with these constructions of braziers, air escaping out of the brazier is a major problem. Further, the escaping air almost certainly is mixed with incomplete combustion gases, further reducing the efficiency of the boiler. Additionally, it has been found essential to ensure that adequate air is provided into the centre of the brazier and also into the hot combustion gases as they rise out of the brazier. The efficient control of the air is an essential requirement for optimum burning conditions and thus optimum operation of the boiler.

Another problem that has been identified is the need to provide boilers of different heat outputs which causes difficulties in that braziers of different sizes have to be provided.

A problem with present constructions of such boilers is that they are often not cleaned adequately or indeed, more importantly, at the right time intervals. If the boiler is relatively inefficiently operated, then very quickly a skin of ash builds up on the boiler walls, reducing the heat transfer capacity of the boiler. A further problem is that very often the brazier is not emptied frequently enough. This is particularly a problem when the boiler is operating somewhat close to maximum capacity.

An additional problem that has been noted with these boilers is the amount of carbon monoxide and other incomplete combustion gases which are delivered out of the boiler flue into the atmosphere during start-up. This is particularly a problem when the boiler is working at well under normal capacity as it is starting up and shutting down a considerable number of times in any period of operation. Again something needs to be done to improve the efficiency of combustion during start-up.

What has to be emphasised about most of these problems is that they are not of themselves when taken singularly seen as being of major importance however it is the cumulative effect of these problems that has led to a less than satisfactory performance in the market place.

Heretofore, while granular fuel fired boilers such as wood pellet boilers have been welcomed and installed on quite a large scale in many countries, they have not, by any means, been successful. This unfortunately has led to a very bad reputation for such granular fuel burning boilers and indeed their abandonment by many of their original champions.

The initial problem related to the indifferent quality of granular fuel and particularly wood pellets. Most of the problems encountered with the fuels and their storage have been generally resolved. It was felt by many that when these problems were solved the granular fuel burning boilers would operate satisfactorily. Unfortunately, that was not the case. It just merely highlighted the remaining problems which have now come to prominence. Indeed, we believe that many of these problems were not fully appreciated by those in the industry heretofore. Many were aware that, for example, there was too much ash build up within the boiler, relatively large percentages of carbon monoxide in the exhaust flue and so on, without appreciating the reason for these. These often apparently minor problems were largely centred round the handling of the combustion products and the fuel. The boilers must operate at required efficiency without requiring constant attention and maintenance by the householder. Until these problems are solved, the clear advantages of using a granular fuel burning boiler will not be appreciated by the consumer.

OBJECTS

The present invention is directed towards overcoming some of these problems and to providing a more efficient construction of such an enclosed granular fuel burning boiler. To summarise the general objects of the present invention, they are to provide a granular fuel burning boiler which will operate satisfactorily, particularly in domestic situations where the householder does not want to be constantly attending to the boiler removing ash and generally carrying out cleaning operations. While the householder may wish to embrace the idea of using reusable energy and embracing the Green Revolution, at the same time, the householder wishes to have a boiler that operates at the same efficiency as other fuel fired boilers such as gas and oil fired boilers.

SUMMARY OF THE INVENTION

According to the invention there is provided an enclosed granular fuel burning boiler, including:

an enclosed combustion chamber;

a fuel-fired brazier mounted in the combustion chamber and comprising an apertured grate-like brazier base and upstanding side walls, namely, a proximal wall, a distal wall, at least portion of which distal wall adjacent the base is either substantially vertical or inclined downwardly and slightly away from the proximal wall, and a pair of connecting side walls;

an actuator for moving the brazier base from an operative position retaining fuel in the brazier to a discharge position to allow ash contents to fall out of the brazier;

fragmentation means comprising a vitrified ash engaging crushing tooth mounted on and projecting upwardly from the base whereby, on moving the brazier base to the discharge position, the vitrified ash engaging crushing tooth moves the vitrified ash across the brazier from the proximal wall and against the opposed distal wall;

a plenum chamber mounted outside the combustion chamber; and a fan for delivering air to the brazier from the plenum chamber.

The advantage of this is that there are no moving parts other than the brazier base to fragment the vitrified ash. It is an extremely efficient way of crushing the vitrified ash. It has been found that providing a distal wall which is either substantially vertical or inclined downwardly and slightly away from the proximal wall so as to trap the vitrified clinker between the crushing tooth and the distal wall and prevent it overriding the crushing tooth and falling back on to the brazier is particularly advantageous. Heretofore, all braziers were generally constructed with inwardly inclined walls to facilitate delivery of fuel. This does not seem to be a major problem, however, in practice, it is and it is detrimental to the efficiency of the boiler to have large amounts of vitrified clinker in the brazier preventing adequate combustion of the fuel. Essentially therefore, what is required is to ensure that the distal wall does not slope upwardly away from the advancing crushing tooth.

In a modification of this embodiment the vitrified ash engaging crushing tooth is similarly inclined and configured such that when it projects into a receiving through-slot in the proximal wall when in the operative position, its surface facing the distal wall is substantially parallel to the opposed surface of the distal wall. This further increases the efficiency of the crushing operation. Indeed, many other configurations of the crushing tooth may be provided. For example outwardly projecting relatively sharp protrusions may be mounted on the front face of the crushing tooth to further engage the hardened clinker and prevent large expanses of clinker being formed.

In one embodiment of the invention a load absorbing connector is mounted between the actuator and the brazier base. This further ensures that the crushing tooth is adequately protected against damage.

This has the advantage of ensuring that too much pressure is not exerted by the crushing tooth against the proximal wall when, for example, a lump of vitrified ash is trapped between the crushing tooth and the proximal wall.

Ideally there is more than one ash engaging crushing tooth. Indeed the number of teeth can vary considerably depending on the boiler load.

In another embodiment of the invention, the mating surfaces between the base and the side walls are parallel and close together to provide a relatively tight combustion gas seal. This has been found to substantially improve the combustion within the brazier, in particular it prevents combustion gas being delivered out of the brazier. Indeed, it has been found advantageous to machine the mating surfaces so as to facilitate this gas seal.

A plurality of air inlet holes is provided in the upstanding walls of the brazier. These ensure that adequate air is provided to the burning fuel. Again it has been found that heretofore not enough attention has been paid to providing air to the burning fuel in the correct quantities and at the correct locations within the boiler.

The number of air inlet holes is varied depending on the heat output requirements of the boiler. This has been found to be a very effective way of varying the heat output of boilers without the necessity to provide different sizes of brazier.

With the enclosed granular fuel boilers, as described above, a diverter plate is mounted on or adjacent the distal wall of the brazier to direct granular fuel which on delivery into the brazier would fall over the distal wall back into the brazier. The diverter plate is simply an extension of the front of the brazier enclosure. The advantage of this is that when pellets fall out of the brazier they do not fall on to the ash in the ash pan where the heated ash causes them to burn inefficiently giving off carbon monoxide. Again this would not appear to be a major problem but in fact it is a problem which causes considerable difficulties. The householder notices that there is a considerable amount of smoke from the boiler and presume is that it is operating inefficiently, and indeed it is.

In a further embodiment of the invention an airflow diverter is mounted above each side wall of the brazier. The airflow diverter is provided by a plate projecting from the adjacent side wall and across portion of the brazier base. The advantage of the airflow diverter is to ensure that air is delivered down into the centre of the brazier for efficient combustion.

In a still further embodiment of the invention there is provided a granular fuel supply tube mounted above the brazier for delivery of fuel under gravity to the brazier and in which flow control means are provided. The advantage of the flow control means is to ensure that the granular fuel, very often wood pellets, is delivered into the brazier as gently as possible. This prevents the wood pellets hopping up against the diverter plate and also avoids disturbing the burning fuel in the brazier.

The flow control means can be comprised of a bore reducing constriction in the granular fuel supply tube. Such a bore reducing constriction comprises a plate projecting across the granular fuel supply tube.

In another embodiment of the invention the flow control means is in a delivery chute for the brazier fed by the granular fuel supply tube, the delivery chute having an upstanding barrier to reduce the flow speed of the granular fuel and to direct granular fuel towards the sides of the brazier as it enters the brazier.

In accordance with another embodiment of the invention, there is provided an enclosed granular fuel burning boiler including:

an enclosed combustion chamber;

a fuel-fired brazier mounted in the combustion chamber and comprising an apertured grate-like brazier base and upstanding side walls, namely, a proximal wall, a distal wall at least portion of which distal wall adjacent the base is either substantially vertical or inclined downwardly and slightly away from the proximal wall, and a pair of connecting side walls;

an actuator for moving the brazier base from an operative position retaining fuel in the brazier to a discharge position to allow ash contents to fall out of the brazier;

fragmentation means for breaking up any vitrified ash contained in the brazier when the brazier base is moved to the discharge position;

a plenum chamber mounted outside the combustion chamber;

a fan for delivery of air from the plenum chamber to the brazier; and a burner hood projecting over the brazier and forming part of a substantially sealed brazier enclosure mounted on a side wall of the boiler, the brazier enclosure including an enclosure base and two upstanding spaced-apart side walls carrying the burner hood and the brazier's upstanding side walls, the enclosure base having an enclosure ash contents discharge hole, a movable support plate having an upright end wall forming portion of the brazier enclosure and having a support plate discharge hole offset from the ash contents discharge hole when in a boiler firing condition, the support plate carrying the brazier base.

With this construction of burner hood, it is possible to ensure that the burner hood is sufficiently close to the brazier to ensure optimum burning conditions. Heretofore it was not realised how important it was to have the air delivered out of the hood and was merely seen as being largely advantageous for protection of the hood from damage. Tests have shown that under optimum running conditions the carbon monoxide in the exhaust flue can be as low as 50 ppm and indeed under normal operating conditions is usually well below 90 ppm. This particular construction of brazier enclosure allows for the very efficient discharge of ash.

Ideally the brazier base is formed from an elongate plate having a discharge hole which is over and communicates with the support plate discharge hole.

In another embodiment of the invention the burner hood forms at its distal end portion of a combustion gas outlet in the brazier enclosure at least portion of which burner hood is hollow and comprises an upper enclosed air chamber connecting with the fan and a plurality of air discharge outlets in the air chamber for delivery of air above the brazier. Ideally the air discharge outlets are adjacent a distal end face of the hood.

Further the invention provides a method of operating an enclosed granular fuel burning boiler as described above, in which the following steps are carried out:

the enclosed granular fuel burning boiler is run for a preset time turning on and off as heating requirements dictate;

the enclosed granular fuel burning boiler is stopped;

the brazier base is moved to the discharge position;

the brazier base is subsequently moved to the operating position; and the enclosed granular fuel burning boiler is restarted and run for the preset time.

The great advantage of doing this is that it ensures that there is less possibility of too much vitrified ash been produced and also it ensures that the apertures in the brazier are not obstructed with consequent inefficient combustion. It is of vital importance to ensure that the brazier is emptied frequently. Very often when a boiler is operating at its maximum output there is little opportunity for cleaning with present constructions.

The preset time may be set by measuring the time the enclosed granular fuel burning boiler was operating. This is an efficient way of ensuring that adequate cleaning takes place.

In the method according to the invention the number of times in which the enclosed granular fuel burning boiler was cleaned is recorded and, after a preset number of cleaning cycles, a service requirement indication is provided. This is very important for the householder who may not be aware when servicing is required because all he or she will note is that the boiler was running for 6 months for example. In one case because of relatively little use in that 6 months period there would be no need for a service and another case with a very heavily used boiler servicing may be essential.

Ideally, on start-up the amount of air delivered to the boiler is less than that required for full combustion and only increased when the granular fuel is burning satisfactorily. This ensures that optimum burning conditions are achieved as quickly as possible.

In another method on start-up the amount of air delivered to the boiler is reduced from that required for normal operation and only gradually increased until optimum burning conditions are achieved. The whole purpose of this is to ensure that there is not incomplete combustion.

BRIEF DESCRIPTION OF THE DRAWINGS

The invention will be more clearly understood by the following description of some embodiments thereof, given by way of example only, with reference to the accompanying drawings, in which.

DETAILED DESCRIPTION OF THE INVENTION

Before describing the invention, reference is made to the disclosures of some pending patent applications, which are in the public domain, namely, Irish Patent Application Number 2007/0226 filed Mar. 29, 2007, entitled "A Solid Fuel Boiler", UK Patent Application Number 0821060.1, filed Nov. 18, 2008, entitled "A Granular Fuel-Fired Boiler Brazier" and PCT Patent Application Number PCT/EP2009/067898 filed Dec. 23, 2009, entitled "A Dual Fuel Boiler" (Publication No. WO2010/072830). The disclosure of the specifications of each of these applications is incorporated herein by way of direct reference.

Figure 1:
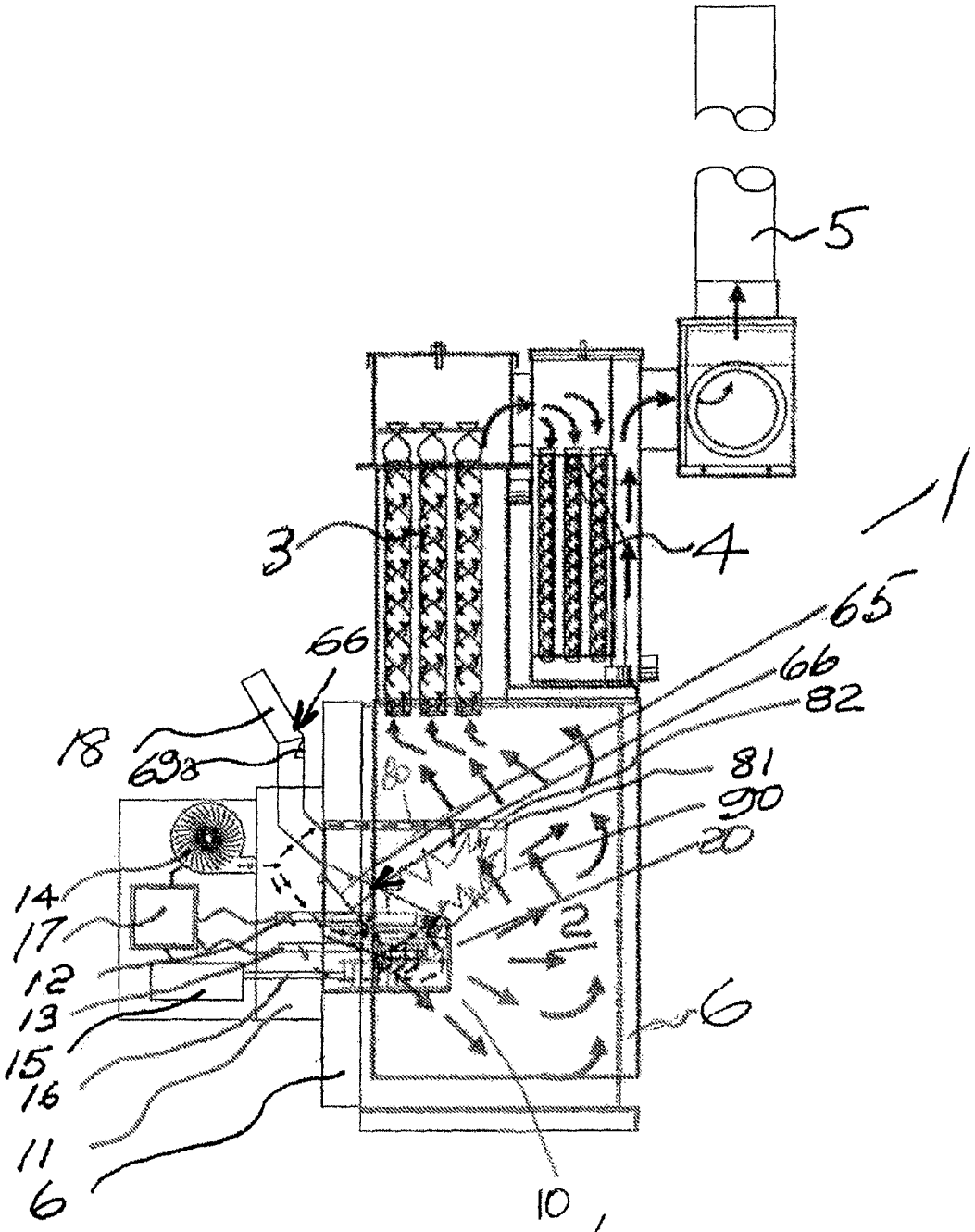
FIG. 1 is a partially diagrammatic sectional elevational view of an enclosed granular fuel burning boiler according to the invention in its operating position.

Referring to the drawings and initially to FIG. 1 thereof, there is illustrated an enclosed granular fuel burning boiler indicated generally by the reference numeral 1 comprising a combustion chamber 2 feeding heat exchangers 3 and condensing tubes 4 which in turn feed a flue 5, all of which have been described in our co-pending UK Patent Application Number 0821060.1 The combustion chamber 2 has water carrying walls 6, only portion of which are illustrated.

A brazier enclosure, indicated generally by the reference numeral 10, is mounted in the combustion chamber 2 on a side wall 6. A plenum chamber 11 is mounted on the exterior of the combustion chamber 2 and houses a photocell 12, ignition element 13 and is fed combustion air by a fan 14. An actuator 15, in this embodiment a servo-motor having a telescopic driveshaft 16, is also illustrated. General control equipment is identified by the reference numeral 17. None of these, except the telescopic driveshaft 16, will be described in any more detail. There is also illustrated a granular fuel supply tube 18, an outlet of which discharges into the brazier enclosure 10, which will also be described in more detail later.

Figure 2:
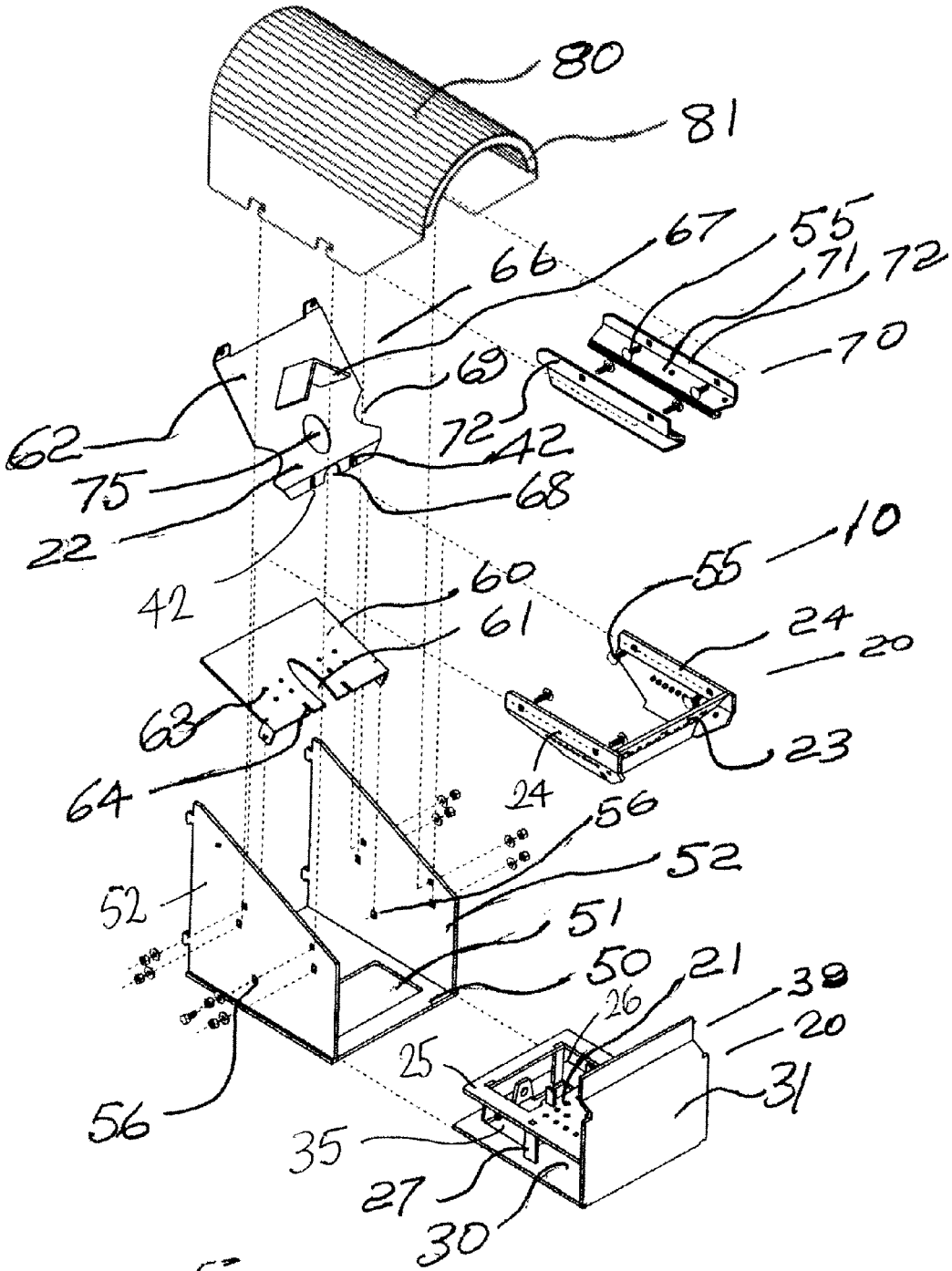
FIG. 2 is a detail exploded perspective view of portion of the boiler.
Figure 4:
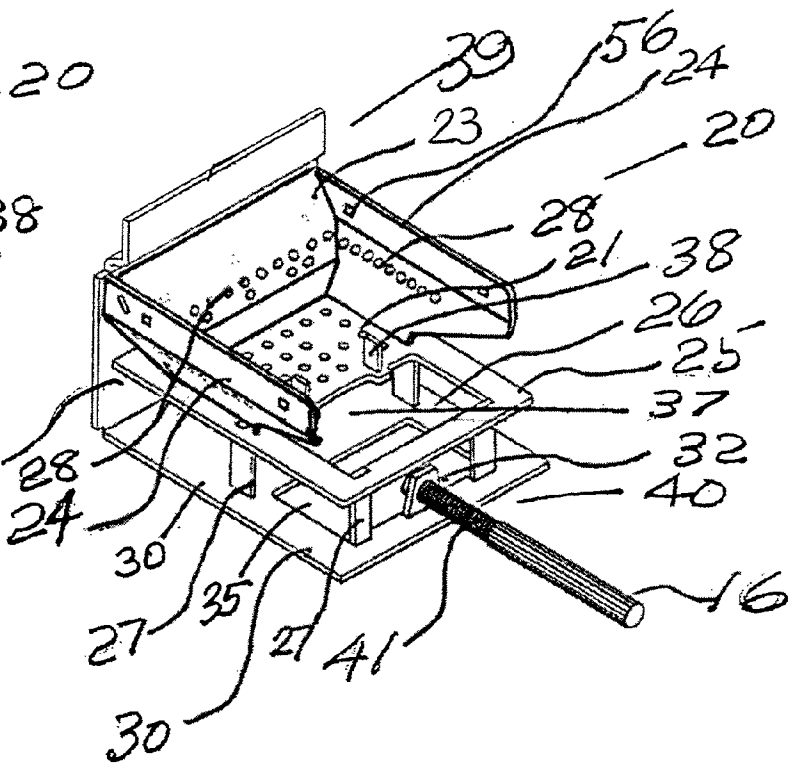
FIG. 4 is a detail perspective view of part of a brazier according to the invention in the operating position.
Figure 5:
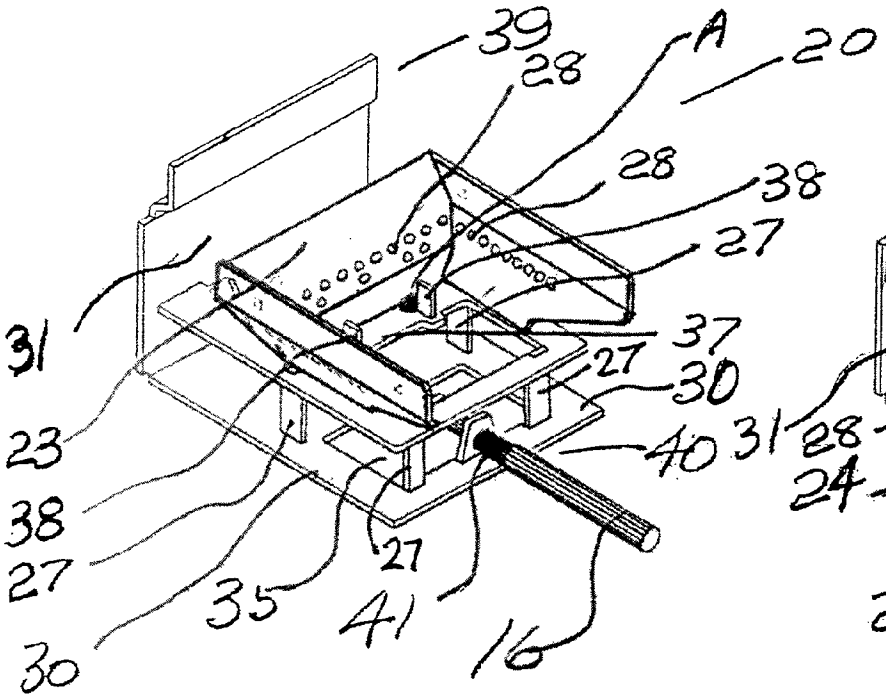
FIG. 5 is a detail perspective view of the brazier of FIG. 4 in the cleaning position.
Figure 6:
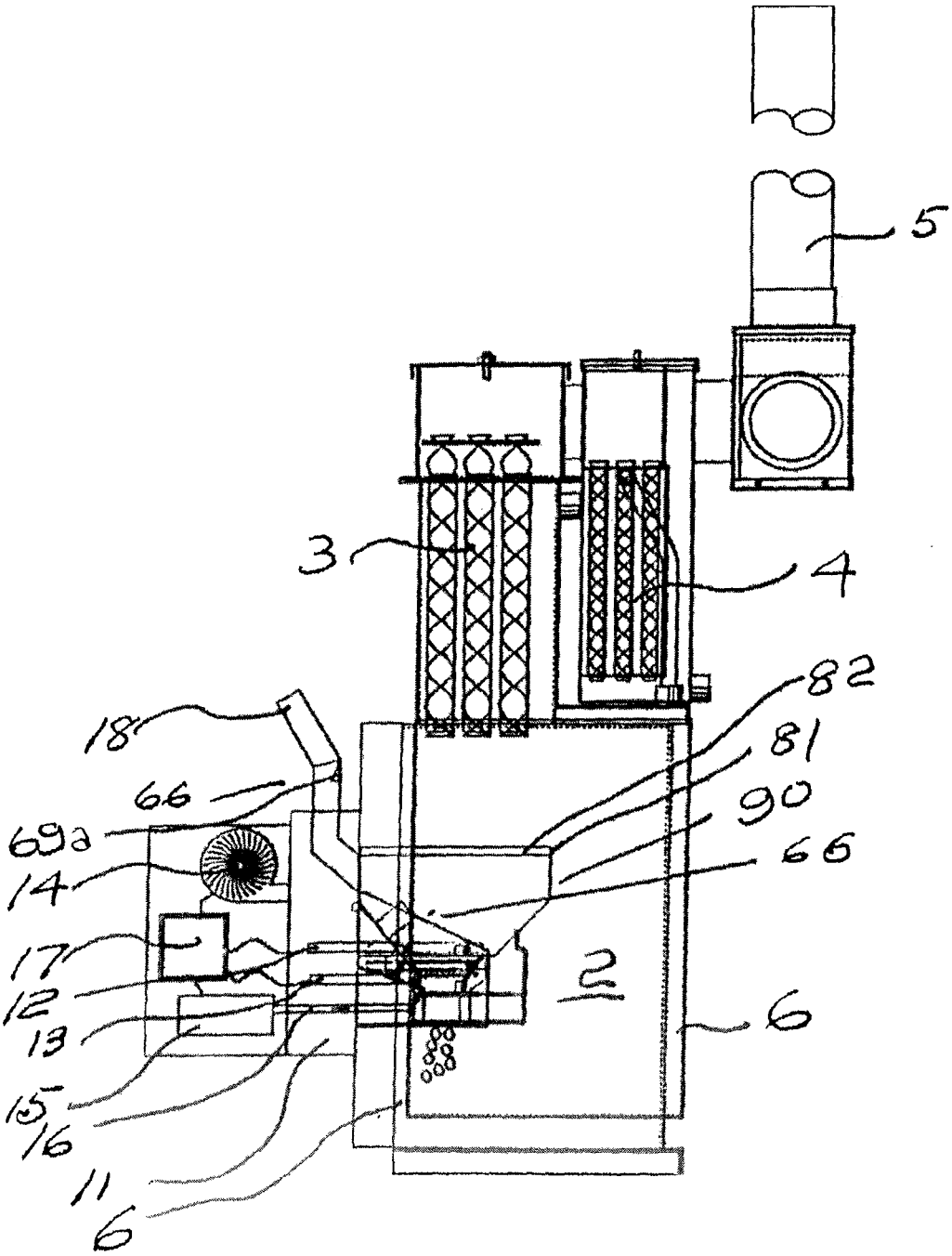
FIG. 6 is a view similar to FIG. 1 illustrating the granular fuel burning boiler in the cleaning position, FIGS. 7 (*a*) and (*b*) are detail sectional diagrammatic views of portion of the brazier, and, FIGS. 8 (*a*) and (*b*) are views similar to FIGS. 7 (*a*) and (*b*) of portion of an alternative construction of brazier according to the invention.

While illustrated and identified by the reference numeral 20 in FIG. 1, a fuel-fired brazier 20, housed within the brazier enclosure 10, is more clearly illustrated in FIGS. 2, 4 and 5. The fuel-fired brazier 20 comprises an apertured grate-like brazier base 21 and upstanding side walls namely a proximal wall 22 (not shown in FIGS. 4 and 5), a distal wall 23 and a pair of connecting side walls 24. The proximal wall 22, as illustrated in FIG. 2, is formed by portion of a brazier plate 62 which is described in more detail later.

The brazier base 21 is formed from an elongate plate 25 having a discharge hole 26, which plate 25 is in turn supported by uprights 27 on a movable support plate 30 having at an inner end an upright wall 31 forming part of the brazier enclosure 10, (seen most clearly in FIGS. 1 and 2). The upper portion of the upright wall 31 projects above the distal wall 23 to provide an internal diverter plate, indicated generally by the reference numeral 39, the purpose of which will be described later.

Air inlet holes 28 are provided in the upstanding side walls 23 and 24. There are further air inlet holes in the upstanding proximal side wall 22 which will be described in more detail later. Further, the movable support plate 30 has a support plate discharge hole 35 which is below the discharge hole 26.

The mating surfaces between the upstanding side walls 22, and 23 and the brazier base 21 are machined so that they are parallel and close together to provide a relatively tight combustion gas seal. Further, and referring additionally to FIG. 7, the lower portion, that is to say the part of the side wall closest to the brazier base 21 of both the distal wall 23 and proximal wall 22, are each substantially upright.

An upright bored spigot 32 is mounted on the support plate 30 adjacent the outer or proximal end and connected to the telescopic shaft 16 of the servo-motor 15 so as to allow the brazier base 21 to be moved relative to the side walls. A load absorbing connector, indicated generally by the reference numeral 40, is provided between the actuator 15 and the brazier base 21. In this embodiment it is provided by a spring 41 on the telescopic shaft 16.

Mounted on the brazier base 21 is fragmentation means, indicated generally by the reference numeral 37, and in this embodiment comprises a pair of vitrified ash engaging crushing teeth 38, which in the operative position, as illustrated in FIG. 4, are housed in slots 42 (only illustrated in FIG. 2) in the proximal wall 22.

Figure 7:
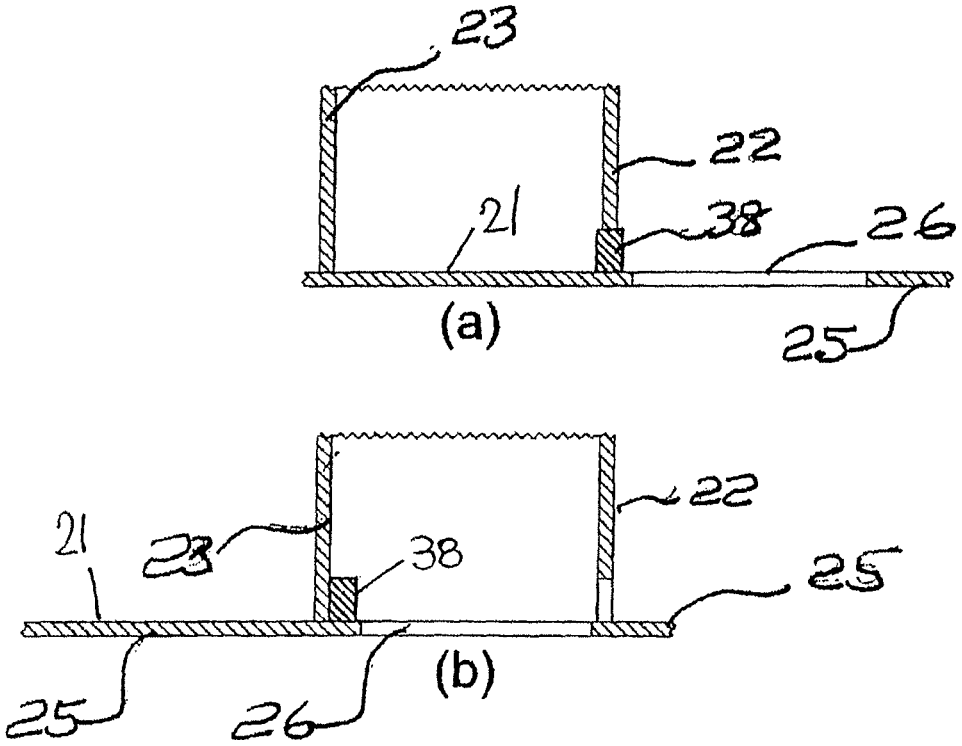

Referring specifically to FIGS. 7 (*a*) and (*b*) it will be noted that the portion of the distal wall 23 adjacent the brazier base 21 is substantially vertical to enable fragmentation with the crushing teeth 38. This has been found to be a more efficient construction than the more conventional shape of brazier which generally has sloping sides and a wider open upper portion than its base. With the latter, it has been found that in some instances the vitrified ash does not get crushed but simply slides up the distal wall 23 and then falls back on to the brazier base 21 as it is retracted.

Referring now to FIG. 2, the brazier enclosure 10 is illustrated in more detail and comprises a brazier enclosure base 50 on which is mounted the movable support plate 30, carrying the brazier base 21. The enclosure base 50 includes an enclosure ash contents discharge hole 51 which is offset in the operating mode from the support plate discharge hole 35 and thus from the discharge hole 26 in the plate 25 which forms the brazier base 21. The brazier enclosure base 50 carries two upstanding side walls 52.

Referring in particular to FIG. 1, on these side walls 52 is mounted a burner hood 80, which will be described in more detail below. This burner hood 80, brazier enclosure base 50, walls 52 and the upright wall 31, together with portion of the water carrying wall 6 which supports it, provide the brazier enclosure 10 and its combustion gas outlet 90 at the distal end 81 of the hood 80 (see FIG. 1).

Above the brazier base 21 the upstanding walls 24 of the brazier 20 are mounted on the side walls 52 by coach bolts 55, i.e. bolts with a short square shank adjacent its' head which are set into square holes 56. These make the removal and replacement of parts so much easier than any other form of mounting bolt.

On each wall 52 is mounted an air flow diverter, indicated generally by the reference numeral 70, positioned above each of the side walls 24 of the brazier 20. In this embodiment, it is provided by a plate 71 projecting from each wall 52 across the side wall 24 and portion of the brazier base 21. The plate 71 is mounted on a support plate 72 and by coach bolts 55 on the side walls 52.

Adjacent the brazier 20 is mounted an element plate 60 through which the ignition element 13 projects through a slot 61. The element plate 60 is mounted again by coach bolts 55 in holes 56 in each wall 52. The element plate 60 has air holes 63 and slots 64 which coincide with the slots 42.

Above the element plate 60 is mounted a further brazier plate 62 forming at its upper end, with the side walls 52, a delivery chute, indicated generally by the reference numeral 65 (see FIG. 1). A flow control means, indicated generally by the reference numeral 66, is provided in the delivery chute 65 by an upstanding barrier 67.

The brazier plate 62 forms at its lower end the proximal wall 22. This proximal wall 22 fits snugly against the side walls 24. The proximal side wall 22 has a combined ignition element receiving slot and an air inlet slot 68 and a pair of side air flow divert and air inlet slots 69. The brazier plate 62 has a further inlet hole 75 for reception of the photocell 12, which inlet hole 75 also forms an air inlet.

The granular fuel supply tube 18 feeds directly onto the delivery chute 65. Further flow control means, again indicated generally by the same reference numeral 66, is provided in the granular fuel supply tube 18 by a bore reducing constriction, in this embodiment, by a plate 69*a* projecting partially across the granular fuel supply tube 18.

Figure 3:
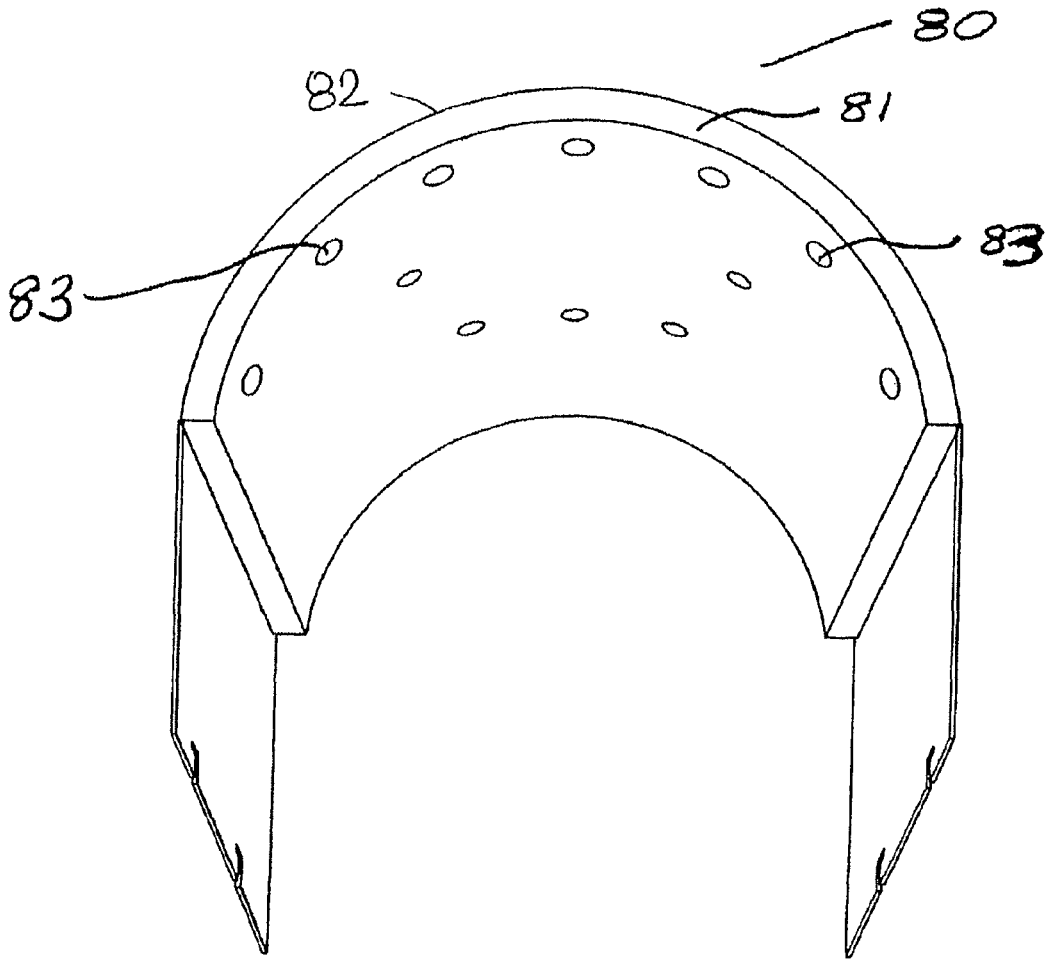
FIG. 3 is an underneath perspective view of a burner hood forming portion of the boiler according to the invention.

Referring now specifically to FIG. 3 and also to FIGS. 1 and 2, the burner hood 80 is of double skinned construction along it's upper portion to provide an upper enclosed air chamber 82. The upper enclosed air chamber 82 has on it's lower surface a plurality of combustion air discharge outlets 83. The air discharge outlets 83 are adjacent the distal of end face 81 of the air chamber 80. As shown in FIG. 1, an open inlet end of the air chamber 82 communicates with and receives air from the air plenum chamber 11.

In operation, the enclosed granular fuel burning boiler 1 is started in the conventional way using the ignition element 13 and a reduced, with respect to normal optimum running conditions, supply of air. This is usually somewhat of the order of 30% or so of the amount of air used for normal running conditions The air is delivered by the fan 14 against and through the side walls 22, 23 and 24 of the brazier 20 and also beneath and up through the brazier base 21. Further, air is delivered into the burner hood 80 and from the upper enclosed air chamber 82 into the brazier enclosure 10. Additionally, air is provided by small amounts of air passing around the photocell 12 and ignition element 13 together with larger quantities of air through the cut-slots 68, 69. As the photocell 12 detects complete combustion, the supply of air is increased to provide optimum ignition.

It will be appreciated that the speed of delivery of the granular fuel will be slowed down by the plate 69*a* in the supply tube 18 and will then be further slowed down by the upstanding barrier 67 which will divert the granular fuel to either side so that it drops gently onto the sides of the brazier 20, or directly onto the outer edges of the brazier base 21. The diverter plate 39 ensures that if any of the granular fuel, which is more often wood pellets, were to bounce on fuel already in the brazier 20, the fuel is trapped and delivered back into the brazier 20. Tests have shown that under optimum running conditions the carbon monoxide in the exhaust flue can be as low as 50 ppm and usually well below 90 ppm even when there has been a considerable build up of ash.

Referring now specifically to FIGS. 4 and 5, if for example a large piece of vitrified ash, identified by the letter A, is trapped between the distal end wall 23 and a crushing tooth 28 it is possible that considerable pressure can be exerted on the actuator 15. For example with a servo motor it would be possible to put a considerable strain on it and possibly damage it. It can be seen how the spring 41 will compress and thus relieve the pressure on the servo motor. Almost certainly, the next time the brazier is being cleaned the ash A will have moved to one side and will then be discharged from the brazier. Such a spring would be generally fairly robust requiring somewhat of the order of 15 to 20 newtons for compression.

Further, the cleaning of the boiler, by moving the brazier base 21, is carried out at regular intervals either controlled entirely by time elapsed or by the amount of time during which the boiler was operating. Further, in another embodiment of the invention when the boiler has carried out a preset number of cleaning operations, a "service requiring indication" is provided.

While in the embodiment described above, the operation is described as having a preset quantity of air provided at ignition and then a further supply of air when ignition has taken place, it will be appreciated that the air supply may be gradually increased from a very low percentage of the optimum air supply on ignition until optimum ignition is achieved.

In the embodiment described above, the portion of the distal wall 23 adjacent the brazier base 21 and thus the vitrified ash engaging crushing tooth 38 is described as being essentially vertical.

Figure 8:
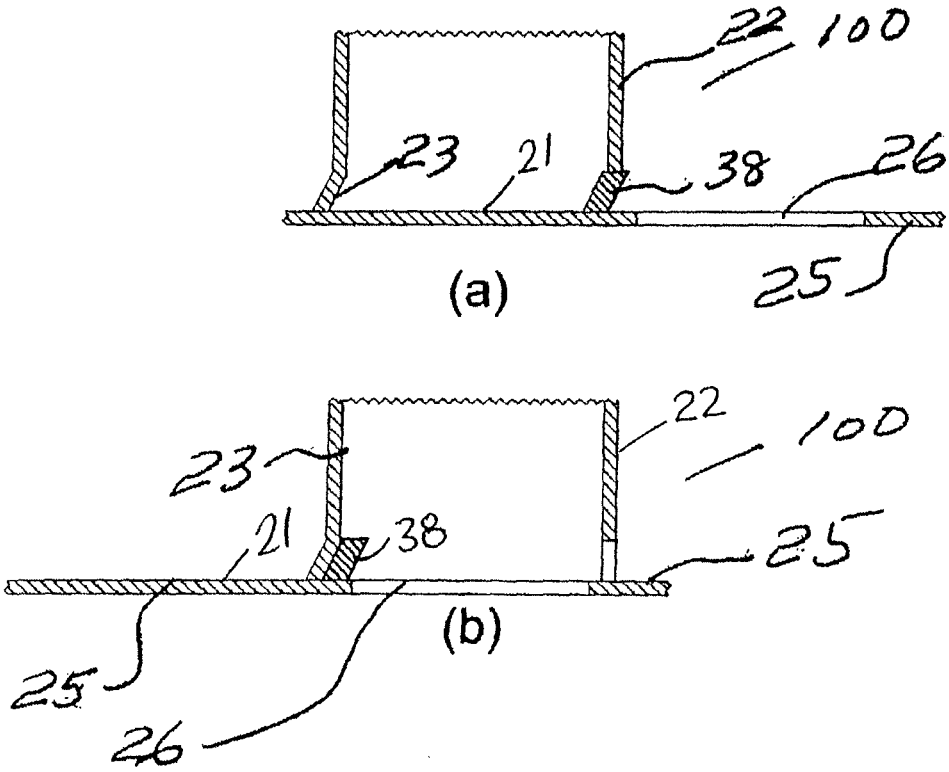

Referring now to FIGS. 8(*a*) and (*b*), there is illustrated portion of an alternative construction of brazier indicated generally by the reference numeral 100, in which parts similar to those described references the previous drawings are identified by the same reference numerals. In this embodiment the distal wall 23 is upwardly inclined towards the proximal wall 22. The vitrified ash engaging crushing tooth 38 is similarly inclined so that effectively as the vitrified ash was pushed across the brazier base 21, it, when trapped against the distal wall 23, will be in a slight enclosure and thus less likely to slide up the distal wall 23. It has been found that this increases the possibility of all the vitrified ash being crushed and not sliding over the crushing tooth 38.

It is envisaged that only one physical size of brazier will be required to provide for most boiler sizes used in domestic premises. By varying the number and size of the air inlet holes in the brazier, it is possible to provide a wide range of heat outputs.

While in the embodiment described above with reference to the drawings, the air discharge outlets in the air chamber of the burner hood are shown only on the inside of the hood adjacent the distal end face of the air chamber, it is possible that air discharge outlets would be provided in other portions of the chamber such as, for example, the distal end face of the air chamber. The latter arrangement would assist in trapping hot combustion gases as they left the brazier enclosure and retaining them in the lower end of the boiler.

In this specification there has been described in claimed what are essentially the practical manner in which the enclosed granular fuel burning boiler may be constructed. It is appreciated that it would be possible for example to operate the crushing tooth in the opposite direction to that described but this has not been described as a would clearly be obvious to those reading this specification that what are quite frankly tortuous and inefficient ways of attempting to avoid infringement of the claims can be carried out. Accordingly, the description and claims are to be read as covering such quite clear modifications.

In this specification the terms "include" and "comprise" and any grammatical variations thereof are used interchangeably and should be accorded the widest possible interpretation.

The invention is not limited to the embodiments described above but may be varied in both construction and detail within the scope of the appended claims.

What I claim is:

1. An enclosed granular fuel burning boiler including:

an enclosed combustion chamber;

a fuel-fired brazier mounted in the combustion chamber and comprising an apertured brazier base and upstanding side walls, namely, a proximal wall, a distal wall at least portion of which distal wall adjacent the base is either vertical or inclined downwardly and away from the proximal wall, and a pair of connecting side walls;

an actuator for moving the brazier base from an operative position retaining fuel in the brazier to a discharge position to allow ash contents to fall out of the brazier;

fragmentation means comprising a vitrified ash engaging crushing tooth mounted on and projecting upwardly from the brazier base whereby, on moving the brazier base to the discharge position, the vitrified ash engaging crushing tooth moves the vitrified ash across the brazier from the proximal wall and against the opposed distal wall;

a plenum chamber mounted outside the combustion chamber;

a fan for delivery of air from the plenum chamber to the brazier; and a burner hood projecting over the brazier and forming part of a substantially sealed brazier enclosure mounted on a side wall of the boiler, the brazier enclosure including an enclosure base and two upstanding spaced-apart side walls carrying the burner hood and the brazier's upstanding side walls, the enclosure base having an enclosure ash contents discharge hole, a movable support plate having an upright end wall forming portion of the brazier enclosure and having a support plate discharge hole offset from the ash contents discharge hole when in a boiler firing condition, the support plate carrying the brazier base.

2. The enclosed granular fuel burning boiler as recited in claim 1, in which the brazier base is formed from an elongate plate having a discharge hole which is over and communicates with the support plate discharge hole.

3. The enclosed granular fuel burning boiler as recited in claim 1 in which the burner hood forms at its distal end portion of a combustion gas outlet in the brazier enclosure, at least portion of which burner hood is hollow and comprises an upper enclosed air chamber connecting with the fan and a plurality of air discharge outlets in the air chamber for delivery of air above the brazier.

4. An enclosed granular fuel burning boiler, including:

an enclosed combustion chamber;

a fuel-fired brazier mounted in the combustion chamber on a side wall of the combustion chamber, said brazier comprising an apertured brazier base and upstanding side walls, namely, a proximal wall adjacent said side wall of the combustion chamber, a distal wall remote from said side wall of the combustion chamber, at least portion of which distal wall adjacent the brazier base is either vertical or inclined downwardly and away from the proximal wall, and a pair of connecting side walls;

an actuator for moving the brazier base from an operative position retaining fuel in the brazier to a discharge position to allow ash contents to fall out of the brazier;

fragmentation means comprising a vitrified ash engaging crushing tooth mounted on and projecting upwardly from the brazier base whereby, on moving the brazier base to the discharge position, the vitrified ash engaging crushing tooth moves the vitrified ash across the brazier from the proximal wall and against the opposed distal wall;

a plenum chamber mounted outside the combustion chamber;

a fan for delivering air to the brazier from the plenum chamber; and a burner hood projecting over the brazier and forming part of a substantially sealed brazier enclosure mounted on a side wall of the boiler, the brazier enclosure including an enclosure base and two upstanding spaced-apart side walls carrying the burner hood and the brazier's upstanding side walls, the enclosure base having an enclosure ash contents discharge hole, a movable support plate having an upright end wall forming portion of the brazier enclosure and having a support plate discharge hole offset from the ash contents discharge hole when in a boiler firing condition, the support plate carrying the brazier base.

5. The enclosed granular fuel burning boiler as recited in claim 4 in which the vitrified ash engaging crushing tooth is inclined and configured such that when it projects into a receiving through-slot in the proximal wall when in the operative position, its surface facing the distal wall is parallel to the opposed surface of the distal wall.

6. The enclosed granular fuel burning boiler as recited in claim 4 in which a load absorbing connector is mounted between the actuator and the brazier base.

7. The enclosed granular fuel burning boiler as recited in claim 4, in which a plurality of air inlet holes are provided in the upstanding side walls of the brazier.

8. The enclosed granular fuel burning boiler as recited in claim 4 in which a plurality of air inlet holes are provided in the upstanding side walls of the brazier the number of which is varied depending on the heat output requirements of the boiler.

9. The enclosed granular fuel burning boiler as recited in claim 4, in which a diverter plate is mounted on or adjacent the distal wall of the brazier to direct granular fuel into the brazier.

10. The enclosed granular fuel burning boiler as recited claim 4, in which an air flow diverter is mounted above each connecting side wall of the brazier.

11. The enclosed granular fuel burning boiler as recited in claim 4, in which an air flow diverter is positioned above each of the side walls of the brazier, said air flow diverter provided by a plate projecting from each of the side walls on the brazier enclosure base.

12. The enclosed granular fuel burning boiler as recited in claim 4, comprising a granular fuel supply tube mounted above the brazier for delivery of fuel under gravity to the brazier and in which flow control means are provided.

13. An enclosed granular fuel burning boiler, including:

an enclosed combustion chamber;

a fuel-fired brazier mounted in the combustion chamber on a side wall of the combustion chamber, said brazier comprising an apertured brazier base and upstanding side walls, namely, a proximal wall adjacent said side wall of the combustion chamber, a distal wall remote from said side wall of the combustion chamber, at least portion of which distal wall adjacent the brazier base is either vertical or inclined downwardly and away from the proximal wall, and a pair of connecting side walls;

an actuator for moving the brazier base from an operative position retaining fuel in the brazier to a discharge position to allow ash contents to fall out of the brazier;

fragmentation means comprising a vitrified ash engaging crushing tooth mounted on and projecting upwardly from the brazier base whereby, on moving the brazier base to the discharge position, the vitrified ash engaging crushing tooth moves the vitrified ash across the brazier from the proximal wall and against the opposed distal wall;

said vitrified ash engaging crushing tooth having a surface facing the distal wall which is parallel to the opposed surface of the distal wall portion adjacent the brazier base, a plenum chamber mounted outside the combustion chamber;

a fan for delivering air to the brazier from the plenum chamber; and a burner hood projecting over the brazier and forming part of a substantially sealed brazier enclosure mounted on a side wall of the boiler, the brazier enclosure including an enclosure base and two upstanding spaced-apart side walls carrying the burner hood and the brazier's upstanding side walls, the enclosure base having an enclosure ash contents discharge hole, a movable support plate having an upright end wall forming portion of the brazier enclosure and having a support plate discharge hole offset from the ash contents discharge hole when in a boiler firing condition, the support plate carrying the brazier base.

14. The enclosed granular fuel burning boiler as recited in claim 4 comprising a granular fuel supply tube mounted above the brazier for delivery of fuel under gravity to the brazier, and in which flow control means are provided comprising a bore reducing constriction in the granular fuel supply tube.

* * * * *